US007977592B2

(12) United States Patent
Shmukler et al.

(10) Patent No.: US 7,977,592 B2
(45) Date of Patent: Jul. 12, 2011

(54) DOUBLE BREAK DISCONNECT/CONTACT SYSTEM

(75) Inventors: Mark I. Shmukler, Duluth, GA (US); James Ferree, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 407 days.

(21) Appl. No.: 12/208,546

(22) Filed: Sep. 11, 2008

(65) Prior Publication Data

US 2009/0065341 A1 Mar. 12, 2009

Related U.S. Application Data

(60) Provisional application No. 60/971,332, filed on Sep. 11, 2007, provisional application No. 60/971,340, filed on Sep. 11, 2007, provisional application No. 60/971,345, filed on Sep. 11, 2007, provisional application No. 60/971,350, filed on Sep. 11, 2007.

(51) Int. Cl.
*H01H 1/22* (2006.01)

(52) U.S. Cl. ..... 200/244; 335/16

(58) Field of Classification Search ..... 200/244, 200/400, 401; 218/22–27; 335/16, 147, 335/195, 166, 6, 202
See application file for complete search history.

(56) References Cited

U.S. PATENT DOCUMENTS

| | | | | |
|---|---|---|---|---|
| 5,310,971 | A * | 5/1994 | Vial et al. | 200/244 |
| 5,994,988 | A * | 11/1999 | Ferree et al. | 335/190 |
| 6,262,642 | B1 * | 7/2001 | Bauer | 335/16 |
| 6,326,868 | B1 * | 12/2001 | Kranz et al. | 335/8 |
| 6,590,173 | B2 * | 7/2003 | Uchida et al. | 200/244 |
| 7,005,594 | B2 | 2/2006 | Kim | |
| 7,145,419 | B2 * | 12/2006 | Kim | 335/16 |
| 7,148,775 | B2 * | 12/2006 | Park | 335/16 |
| 7,189,935 | B1 | 3/2007 | Hassan et al. | |
| 7,217,895 | B1 * | 5/2007 | Shea et al. | 200/244 |
| 2005/0231308 | A1 | 10/2005 | Kim | |
| 2006/0077022 | A1 | 4/2006 | Kim | |

FOREIGN PATENT DOCUMENTS

| | | | |
|---|---|---|---|
| DE | 10150550 | C1 | 12/2002 |
| EP | 1098343 | A | 5/2001 |

* cited by examiner

*Primary Examiner* — Michael A Friedhofer
(74) *Attorney, Agent, or Firm* — Jose R. de la Rosa

(57) ABSTRACT

The present invention relates generally to a mechanism of a contact system for circuit breakers. More particularly, the invention encompasses a mechanism for a rotary double-break contact system, which enables a direct transfer of torque from stored energy components, such as, springs, to the contact arm in the ON-position (contacts closed) without using intermediate cam surface. The mechanism described in the invention also ensures reliable locking of the contact arm in the blow-off position using stationary means that are integral with or fixed to a crossbar module. This invention enables to achieve significant reduction or even to eliminate friction at certain critical interfaces between the contact mechanism components, thus, reducing or potentially eliminating hysteresis, and improving performance consistency, and also eliminating mechanism performance dependency on wear level and condition of an intermediate cam surface. An additional feature of this invention is a reduction of a loss of contact torque/force during over-travel in the ON position when the fixed and/or moveable contacts erode. Configurations described in this invention may also feature physical protection for the moving components of the contact mechanism assembly from flying particles resulting from short circuit shots.

25 Claims, 11 Drawing Sheets

DOUBLE BREAK DISCONNECT/CONTACT SYSTEM

CROSS-REFERENCE TO RELATED APPLICATION

The instant patent application is related to U.S. Provisional Patent Application Ser. No. 60/971,332, filed on Sep. 11, 2007, titled "Double-Break Disconnect/Contact System," U.S. Provisional Patent Application Ser. No. 60/971,340, filed on Sep. 11, 2007, titled "Rotary Double-Break Contact System Mechanism Directly Creating Contact Torque in the ON position and Locking Contact Arm in the Blow-Off Position," U.S. Provisional Patent Application Ser. No. 60/971,345, filed on Sep. 11, 2007, titled "Double-Break Contact System," and, U.S. Provisional Patent Application Ser. No. 60/971,350, filed on Sep. 11, 2007, titled "Double-Break Circuit Breaker Mechanism," the disclosures of which is incorporated herein by reference.

FIELD OF THE INVENTION

The present invention relates generally to a mechanism of a contact system for circuit breakers. More particularly, the invention encompasses a mechanism for a rotary double-break contact system, which enables a direct transfer of torque from stored energy components, such as, springs, to the contact arm in the ON-position (contacts closed) without using intermediate cam surface. The mechanism described in the invention also ensures reliable locking of the contact arm in the blow-off position using stationary means that are integral with or fixed to a crossbar module. This invention enables to achieve significant reduction or even to eliminate friction at certain critical interfaces between the contact mechanism components, thus, reducing or potentially eliminating hysteresis, and improving performance consistency, and also eliminating mechanism performance dependency on wear level and condition of an intermediate cam surface. An additional feature of this invention is a reduction of a loss of contact torque/force during over-travel in the ON position when the fixed and/or moveable contacts erode. Configurations described in this invention may also feature physical protection for the moving components of the contact mechanism assembly from flying particles resulting from short circuit shots.

BACKGROUND INFORMATION

Conventional contact mechanism assemblies for a circuit breaker use intermediate cam surfaces for transferring the contact torque/force from the stored energy components, such as, springs, to the contact arm in the ON position (contacts closed) and during the contact arm dynamical motion when acted upon by repulsion forces prior to getting locked in the blow-off position. Functional performance of such conventional mechanisms is typically affected by the friction between a rolling or a sliding component, which moves with the contact arm, and the intermediate cam surfaces along the entire trajectory. This results in a significant hysteresis, which is undesirable for the contact system as it brings inconsistency and can cause the contact force between the fixed and moveable contacts in the ON position to be compromised. As an important side effect, the mechanism performance becomes dependent on the wear condition of the cam surface. Furthermore, using the intermediate cam to achieve required torque at the contact arm in the ON position has a negative effect on the mechanism's over-travel performance and it results in substantial loss of a contact force/torque with erosion of the contacts.

Another observed issue with the existing prior art configurations is that in some of them the contact spring-cam mechanism is not physically protected and is substantially exposed. Therefore, it can be contaminated by flying particles (beads) during the short circuit shots.

Other conventional contact systems utilize locking cam surfaces arranged integrally with contact arm for latching it open in the blow-off position thus preventing from undesirable re-closing when the cam surfaces engage locking pins that are loosely attached to the crossbar. These types of configurations have demonstrated unreliability during latching of the contact arm at the end of its trajectory in the blow-open position.

U.S. Pat. No. 4,649,247 (Bernhard Preuss, et al.), the disclosure of which is incorporated herein by reference, discloses a contact mechanism assembly provided for current-limiting low-voltage circuit breakers. The contact mechanism assembly has a two-armed contact lever swivel-mounted on a central bearing pin whose lever arms are equipped at their ends with contact pieces. The contact lever is equipped with a slot for mounting on the bearing pin whose longitudinal axis extends approximately at a right angle to the longitudinal axis of contact lever. The contact lever has a stop extending at approximately a right angle to its longitudinal axis for a catch swivel-mounted on the bearing pin. The contact forces on both lever arms cannot be influenced by the swivel mount or by the drive mechanism of the contact lever, but are determined exclusively by the biasing springs.

U.S. Pat. No. 5,310,971 (Denis Vial, et al.), the disclosure of which is incorporated herein by reference, discloses a contact bridge of a molded case circuit breaker which is rotatably mounted in a bar by two springs arranged symmetrically from the rotation axis. Each spring is, on the one hand, anchored to the contact bridge, and, on the other hand, anchored to a rod housed in a notch of the bar. The same springs provide contact pressure and slowing-down of opening of the contact bridge at the end of repulsion travel by electrodynamic effect. The contact bridge bears on its edge cam surfaces which, at the end of opening travel, engage the anchoring rods to move them in the notches in the elongation direction of the tension springs. The energy of the contact bridge is thus taken up and stored in the springs causing slowing-down of the contact bridge. The profile of the cams can be chosen to enable reclosing of the contact bridge, this reclosing naturally being delayed by the slowing-down effect at the end of travel. The cam profile can also ensure latching of the contact bridge in the open position.

U.S. Pat. No. 7,005,594 (Yong-Gi Kim), the disclosure of which is incorporated herein by reference, discloses a movable contactor assembly of a circuit breaker capable of enhancing a current limiting function by maintaining a contact state between a movable contactor and fixed contactors in a closed circuit state, by preventing the separated movable contactor from returning towards the fixed contactors at the time of a current limiting operation, by accelerating a separation operation of the movable contactor from the fixed contactors at the time of a current limiting operation, and by continuously maintaining a separated state of the movable contactor from the fixed contactors until a trip operation is performed by a trip mechanism.

U.S. Pat. No. 7,145,419 (Yong-Gi Kim), the disclosure of which is incorporated herein by reference, discloses a contactor assembly for a circuit breaker comprises a first spring supporting pin, a cam plate, a second spring supporting plate, a link, and a spring. When a movable contactor is rotated without a rotation axis, a fluctuation of a rotation center of the movable contactor is not generated and a current limiting function is fast performed. Also, after contacts are separated from each other, the movable contactor is prevented from returning towards fixed contactors and the separated position is maintained for a predetermined time. An assembly process of the contactor assembly is simplified.

Thus, a need exists for an improved contact mechanism assembly for a circuit breaker.

This invention overcomes the problems of the prior art and provides an improved contact mechanism assembly for a circuit breaker.

PURPOSES AND SUMMARY OF THE INVENTION

The invention is a novel contact mechanism assembly for a contact system of a circuit breaker.

Therefore, one purpose of this invention is to provide a novel contact mechanism assembly for a circuit breaker.

Still yet another purpose of this invention is to provide a crossbar module (or rotating shaft module) having an integrated locking block(s)/protrusion or surfaces.

Another purpose of this invention is to provide the Crossbar module, which also comprises two symmetrically oriented locking blocks/protrusions/surfaces that are arranged integrally either on the inner sides or on the outer circumference surfaces of the crossbar module or on the separate locking plate, which is fixed to the crossbar module, for guiding the sliding pins only as they approach the very end of their respective trajectories but, more importantly, for locking the sliding pins at the very end of their respective trajectories during a blow-off motion of the Contact Arm.

Yet another purpose of this invention is to provide a direct transfer of torque from a single pair or two pairs of contact springs to a contact arm in the ON position and through much of the contact arm's trajectory during the blow-off motion without using an intermediate cam surface.

Still yet another purpose of this invention is to provide a reliable locking of a contact arm in a blow-off position by using surfaces of either locking blocks/protrusions or a locking plate that are integral with or fastened to a crossbar module.

And yet another purpose of this invention is to reduce or even eliminate friction between the contact mechanism components, such as sliding pins and the Crossbar Module during the short circuit blow-off motion of the Contact Arm until it approaches the end of its trajectory thus minimizing or eliminating hysteresis and mechanism performance dependency on wear level and condition of an intermediate cam surface.

A resulting characteristics of this invention is reducing loss of contact torque/force during over-travel in the ON position when the fixed and/or moveable contacts erode.

Still yet another purpose of this invention is to provide an enclosure for the physical protection of the contact mechanism moving components.

Therefore, in one aspect this invention comprises a mechanism for rotary double-break contact system for a circuit breaker, comprising:

(a) a crossbar module, wherein said crossbar module has a first anchor area and a second anchor area, a first limiting surface and a second limiting surface, a first sliding pin travel surface and a second sliding pin travel surface, a first sliding pin stop area and a second sliding pin stop area, a first contact arm resting surface and a second contact arm resting surface;

(b) a contact arm, wherein said contact arm has a first movable contact and a second movable contact, a first structural stop and a second structural stop, a first outer traveling edge and a second outer traveling edge, and a contact arm slotted opening;

(c) an axle, wherein said axle passes through said contact arm slotted opening and said axle is secured to said crossbar, and said axle allows the pivoting of said contact arm about said axle;

(d) a first spring, wherein one end of said first spring is secured to a first fixed pin and the other end of said first spring is secured to a first sliding pin, and wherein said first pin is secured to said first anchor area on said crossbar module and said first sliding pin is held in place by said first structural stop in said contact arm;

(e) a second spring, wherein one end of said second spring is secured to a second fixed pin and the other end of said second spring is secured to a second sliding pin, and wherein said second pin is secured to said second anchor area on said crossbar module and said second sliding pin is held in place by said second structural stop in said contact arm; and (f) wherein in an ON position said contact arm rests at said first contact arm resting area and said second contact arm resting area, and wherein in a blow-off position said first sliding pin and said second sliding pin engages said first structural stop and said second structural stop of said contact arm and moves said contact arm towards said first limiting surface and said second limiting surface, and thereby forms said mechanism for rotary double-break contact system for a circuit breaker.

In another aspect this invention comprises a mechanism for rotary double-break contact system for a circuit breaker, comprising:

(a) a crossbar module;

(b) a locking plate, wherein said locking plate has a first anchor area and a second anchor area, a first limiting surface and a second limiting surface, a first sliding pin travel surface and a second sliding pin travel surface, a first sliding pin stop area and a second sliding pin stop area, a first contact arm resting surface and a second contact arm resting surface;

(c) a contact arm, wherein said contact arm has a first movable contact and a second movable contact, a first structural stop and a second structural stop, a first outer traveling edge and a second outer traveling edge, a contact arm slotted opening, and wherein said contact arm further comprises a first arm and a second arm, and wherein said first arm and said second arm are connected to each other adjacent said first movable contact and said second movable contact and forming an opening;

(d) an axle, wherein said axle passes through said contact arm slotted opening and said locking plate and said axle is secured to said crossbar, and said axle allows the pivoting of said contact arm about said axle;

(e) a first spring, wherein one end of said first spring is secured to a first fixed pin and the other end of said first spring is secured to a first sliding pin, and wherein said first pin is secured to said first anchor area on said locking plate and said first sliding pin is held in place by said first structural stop in said contact arm;

(f) a second spring, wherein one end of said second spring is secured to a second fixed pin and the other end of said second spring is secured to a second sliding pin, and wherein said second pin is secured to said second anchor area on said locking plate and said second sliding pin is held in place by said second structural stop in said contact arm; and (g) wherein in an ON position said contact arm rests at said first contact arm resting area and said second contact arm resting area, and wherein in a blow-off position said first sliding pin and said second sliding pin engages said first structural stop and said second structural stop of said contact arm and moves said contact arm towards said first limiting surface and said second limiting surface, and thereby forms said mechanism for rotary double-break contact system for a circuit breaker.

In yet another aspect this invention comprises a mechanism for rotary double-break contact system for a circuit breaker, comprising:

(a) a crossbar module;

(b) a locking plate, wherein said locking plate is integrated with crossbar module, and wherein said locking plate has a first anchor area and a second anchor area, a first limiting surface and a second limiting surface, a first sliding pin travel surface and a second sliding pin travel surface, a first sliding pin stop area and a second sliding pin stop area, a first contact arm resting surface and a second contact arm resting surface;

(c) a contact arm, wherein said contact arm has a first movable contact and a second movable contact, a first structural stop and a second structural stop, a first outer traveling edge and a second outer traveling edge, a contact arm slotted opening, and wherein said contact arm further comprises a first arm and a second arm, and wherein said first arm and said second arm are connected to each other adjacent said first movable contact and said second movable contact and forming an opening;

(d) an axle, wherein said axle passes through said contact arm slotted opening and said axle is secured to said crossbar, and said axle allows the pivoting of said contact arm about said axle;

(e) a first spring, wherein said first spring is inside said opening in said contact arm, and wherein one end of said first spring is secured to a first fixed pin and the other end of said first spring is secured to a first sliding pin, and wherein said first pin is secured to said first anchor area on said locking plate and said first sliding pin is held in place by said first structural stop in said contact arm;

(f) a second spring, wherein said second spring is inside said opening in said contact arm, and wherein one end of said second spring is secured to a second fixed pin and the other end of said second spring is secured to a second sliding pin, and wherein said second pin is secured to said second anchor area on said locking plate and said second sliding pin is held in place by said second structural stop in said contact arm; and (g) wherein in an ON position said contact arm rests at said first contact arm resting area and said second contact arm resting area, and wherein in a blow-off position said first sliding pin and said second sliding pin engages said first structural stop and said second structural stop of said contact arm and moves said contact arm towards said first limiting surface and said second limiting surface, and thereby forms said mechanism for rotary double-break contact system for a circuit breaker.

In still another aspect this invention comprises a crossbar module for a circuit breaker, comprising, a first anchor area and a second anchor area, a first limiting surface and a second limiting surface, a first sliding pin travel surface and a second sliding pin travel surface, a first sliding pin stop area and a second sliding pin stop area, a first contact arm resting surface and a second contact arm resting surface, and thereby forming said crossbar module for a circuit breaker.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

DETAILED DESCRIPTION

This invention addresses and overcomes typical problems of the prior art, such as, for example, friction between the contact mechanism components, which results in inconsistent mechanism performance and high hysteresis, mechanism performance dependency on wear level and condition of an intermediate cam surface, substantial loss of contact torque/force during over-travel when the fixed and/or moveable contacts erodes, and unreliable locking of the contact arm in the blow-off position, to name a few.

Figure 1A:
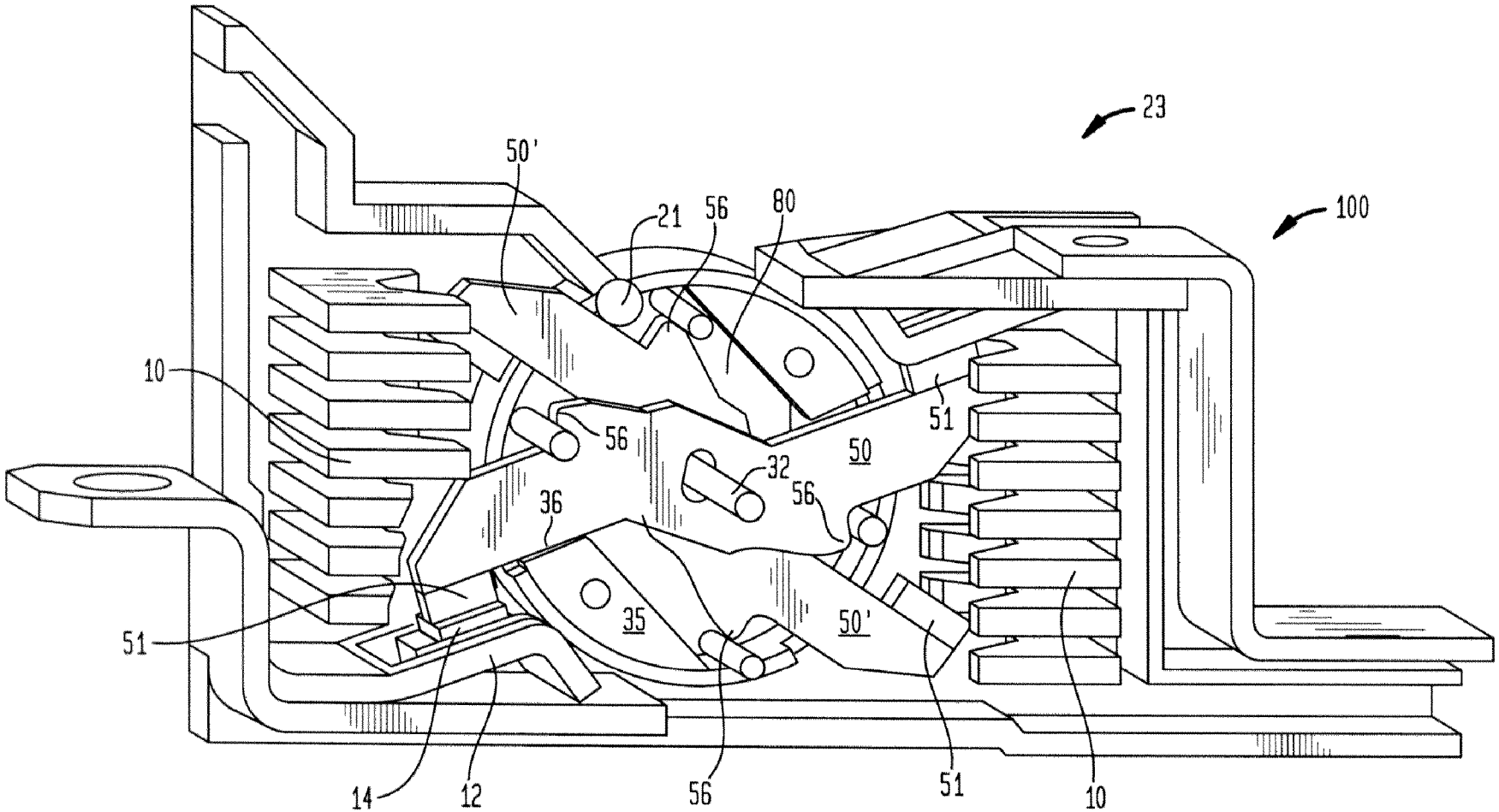
FIG. 1A is a perspective view of the inventive contact mechanism assembly for a circuit breaker illustrating a first embodiment of the present invention showing the contact mechanism inside the cassette housing and the contact arm in the ON position and in the blow-off position.

FIG. 1A is a perspective view of the inventive contact mechanism assembly for a circuit breaker 23, illustrating a first embodiment of the present invention showing the contact mechanism inside a cassette housing 100, with a contact arm 50, in an ON position 50, and then in a blow-off position 50'.

Figure 1B:
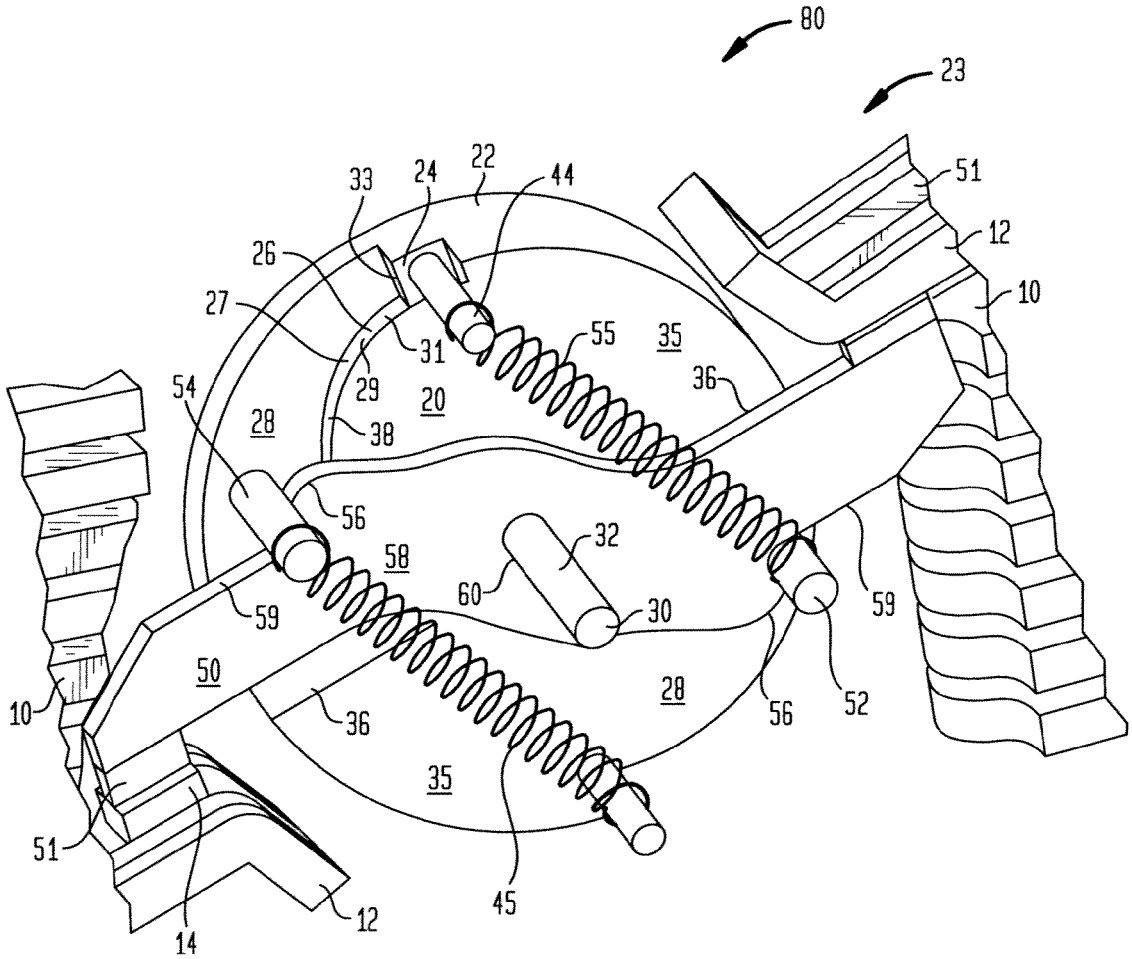
FIG. 1B is a perspective view of the inventive contact mechanism assembly for a circuit breaker illustrating a first embodiment of the present invention showing the contact mechanism and the contact arm in the ON position.

FIG. 1B is a perspective view of the inventive contact mechanism assembly for a circuit breaker 23, illustrating a first embodiment of the present invention showing the contact mechanism and the contact arm 50, in the ON position 50.

Figure 2A:
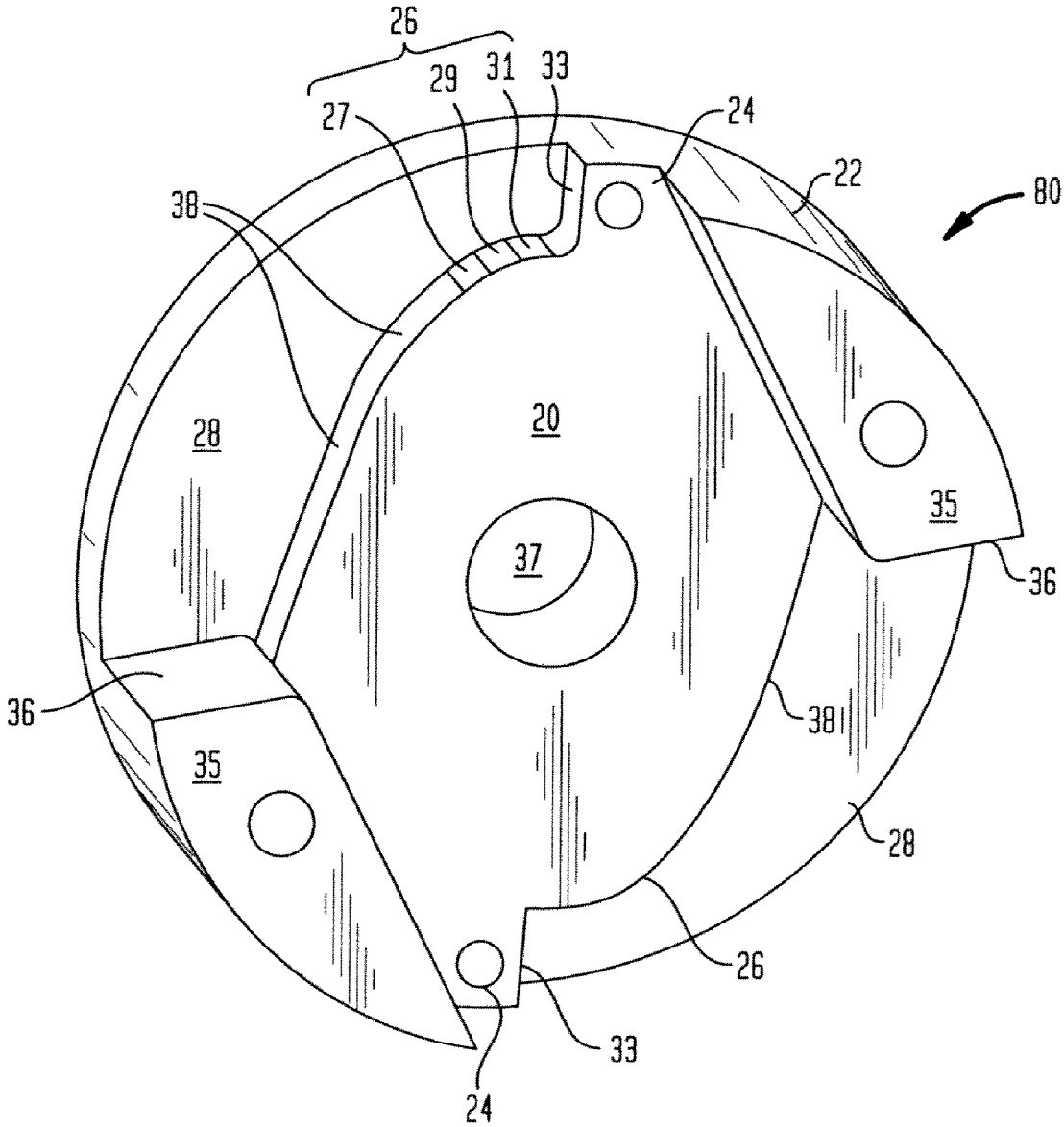
FIG. 2A is a perspective detailed view of one half of the crossbar module of the inventive contact mechanism assembly for a circuit breaker illustrated in FIG. 1.

FIG. 2A is a perspective detailed view of one half of the crossbar module 80, of the inventive contact mechanism assembly for a circuit breaker 23, illustrated in FIG. 1.

Figure 2B:
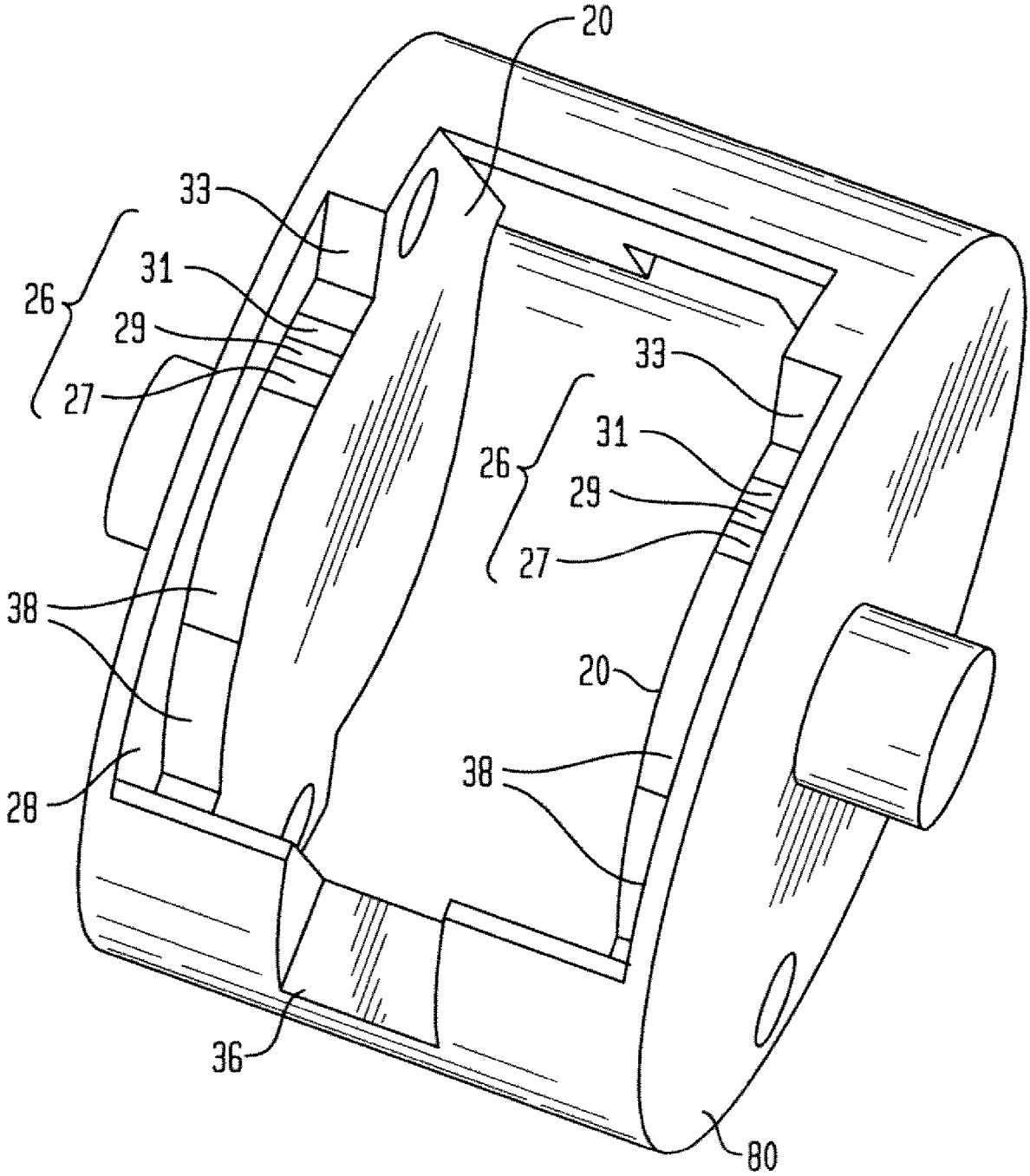
FIG. 2B is a perspective detailed view of both halves of the crossbar module of the inventive contact mechanism assembly for a circuit breaker illustrated in FIG. 1.

FIG. 2B is a perspective detailed view of both halves of the crossbar module 80 or of a crossbar module 80 made of one piece, of the inventive contact mechanism assembly for a circuit breaker 23, illustrated in FIG. 1.

Figure 2C:
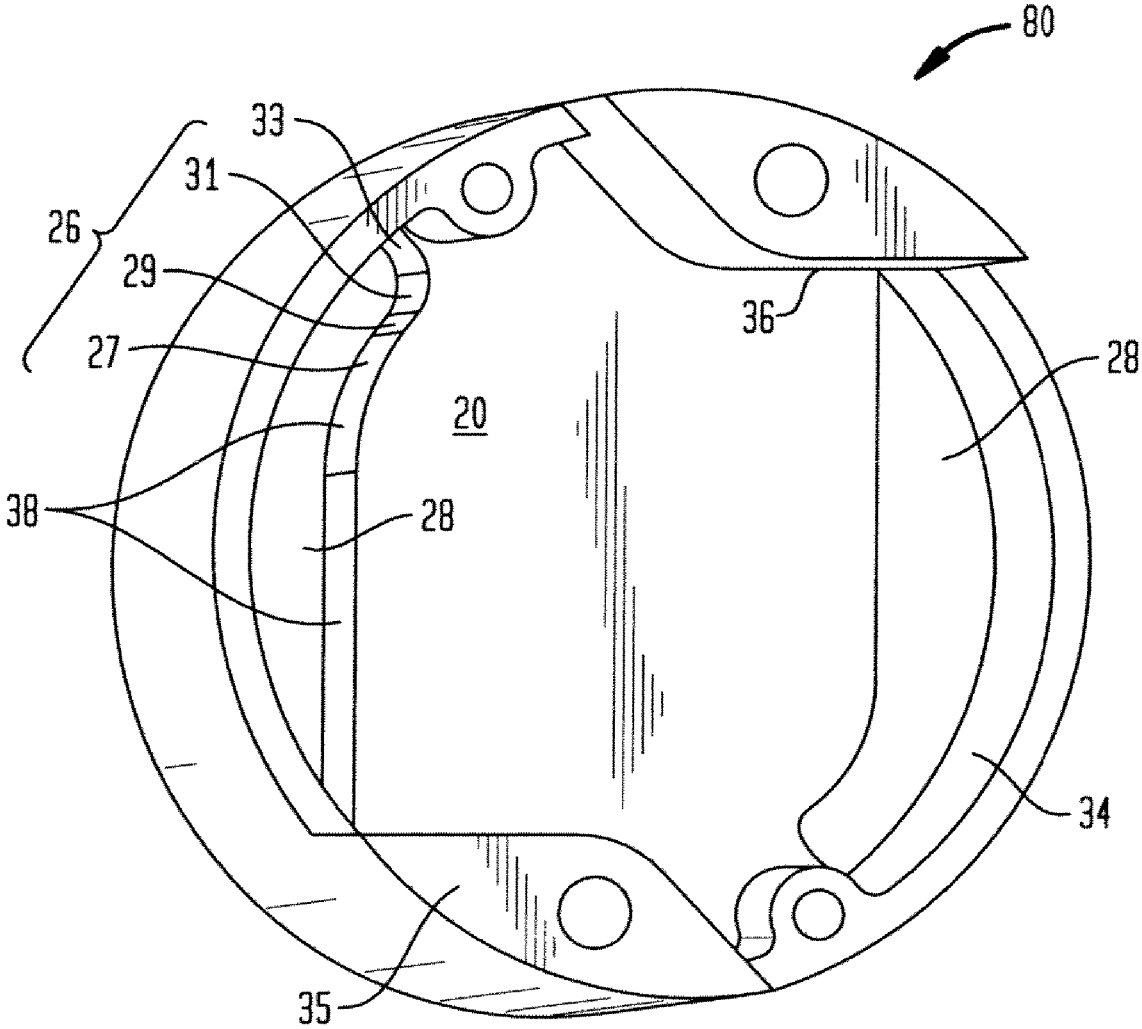
FIG. 2C is a perspective detailed view of one half of the crossbar module with a protective web, which is integral with the crossbar, of the inventive contact mechanism assembly for a circuit breaker illustrated in FIG. 1.

FIG. 2C is a perspective detailed view of one half of the crossbar module 80, with a protective web 34, which is integral with the crossbar of the inventive contact mechanism assembly for a circuit breaker 23, illustrated in FIG. 1.

Figure 2D:
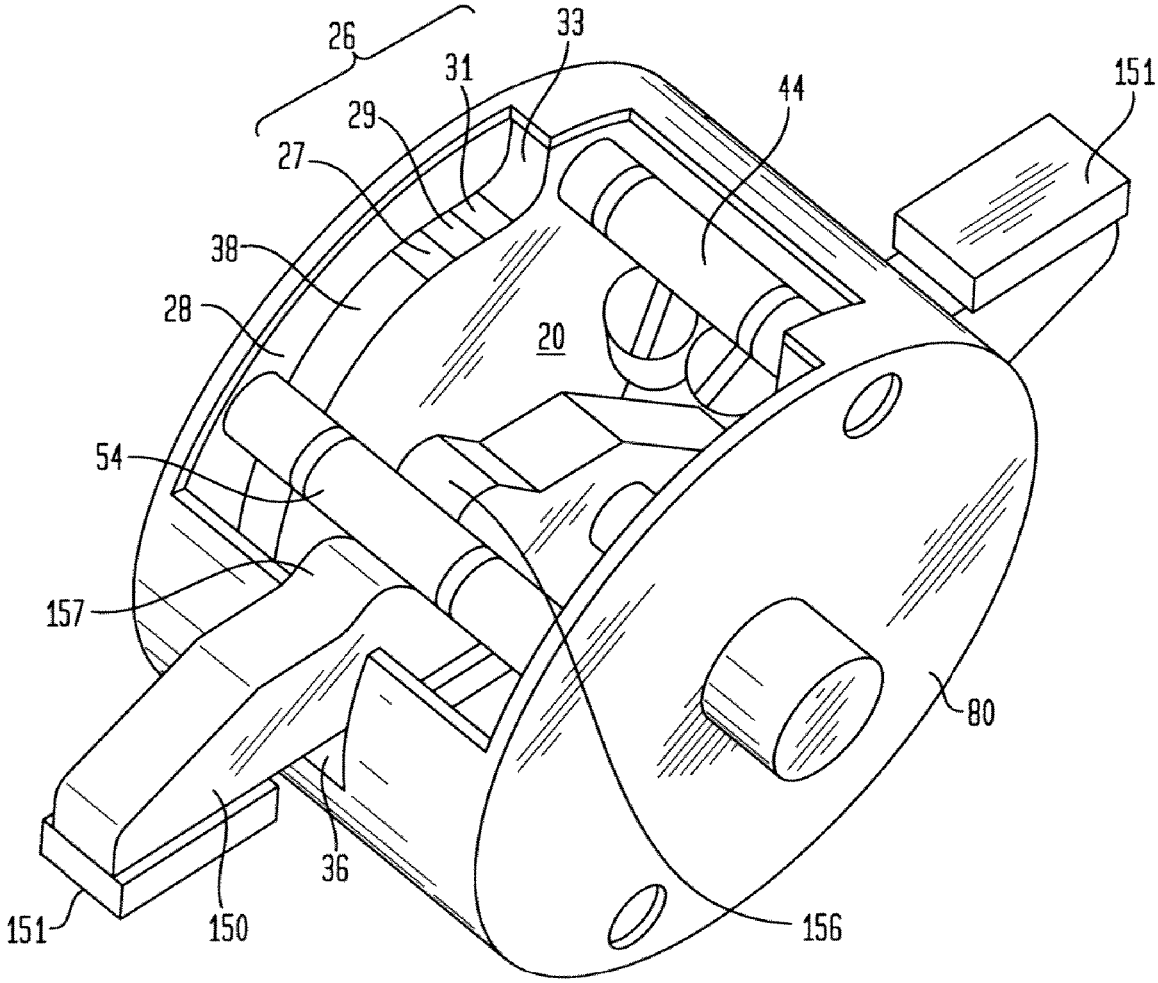
FIG. 2D is a perspective view of the inventive crossbar module assembly, which a crossbar module along with the contact arm, with the sliding pin and with the anchor pin, of the contact mechanism assembly for a circuit breaker illustrated in FIG. 1.

FIG. 2D is a perspective view of the inventive crossbar module assembly, with a crossbar module along with the contact arm, with the sliding pin and with the anchor pin, of the contact mechanism assembly for a circuit breaker illustrated in FIG. 1.

Figure 3A:
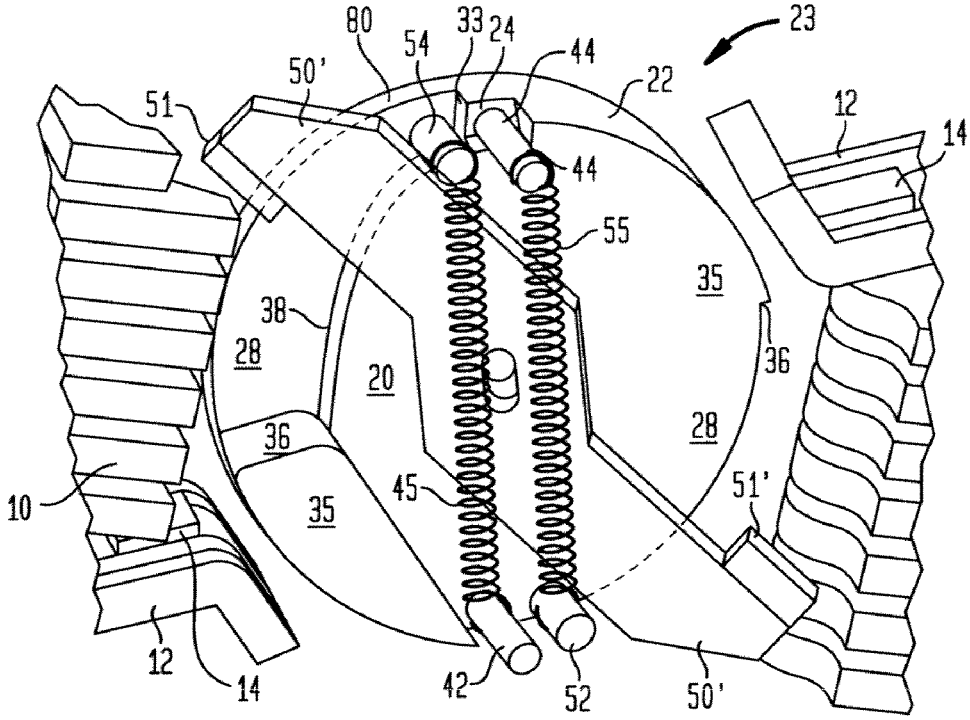
FIG. 3A is a detailed perspective view of the inventive contact mechanism assembly for a circuit breaker illustrated in FIG. 1, with contact arm in the blown-off position.

FIG. 3A is a detailed perspective view of the inventive contact mechanism assembly for a circuit breaker 23, illustrated in FIG. 1, with contact arm 50, in the blown-off position 50'.

Figure 3B:
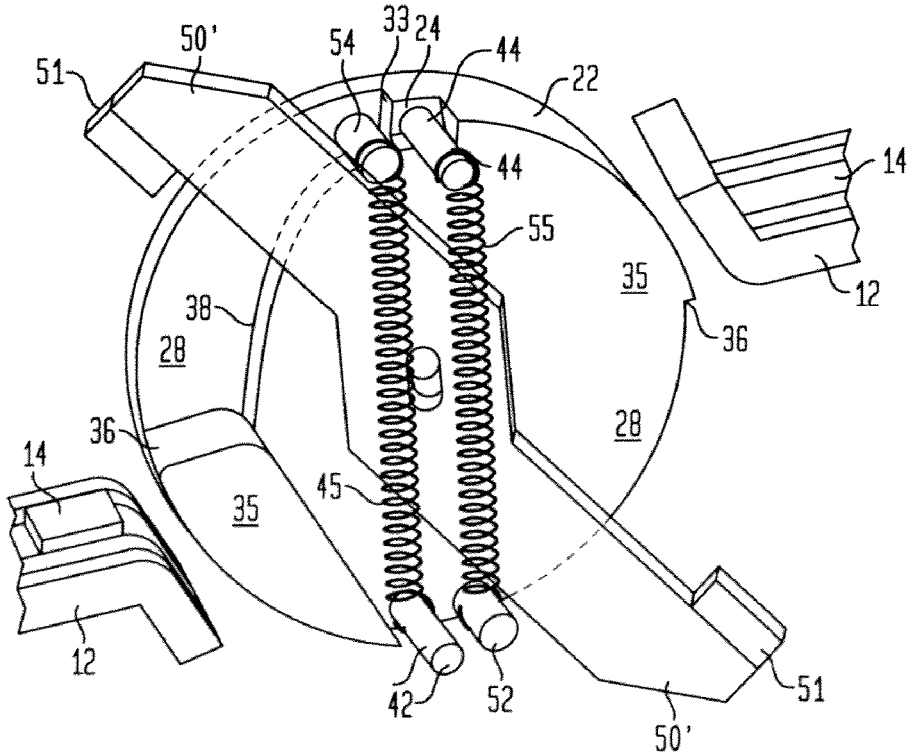
FIG. 3B is a closer perspective view of the inventive contact mechanism assembly for a circuit breaker illustrated in FIG. 3A, with contact arm in the blown-off position.

FIG. 3B is a closer perspective view of the inventive contact mechanism assembly for a circuit breaker 23, illustrated in FIG. 3A, with contact arm 50, in the blown-off position 50'.

Figure 4A:
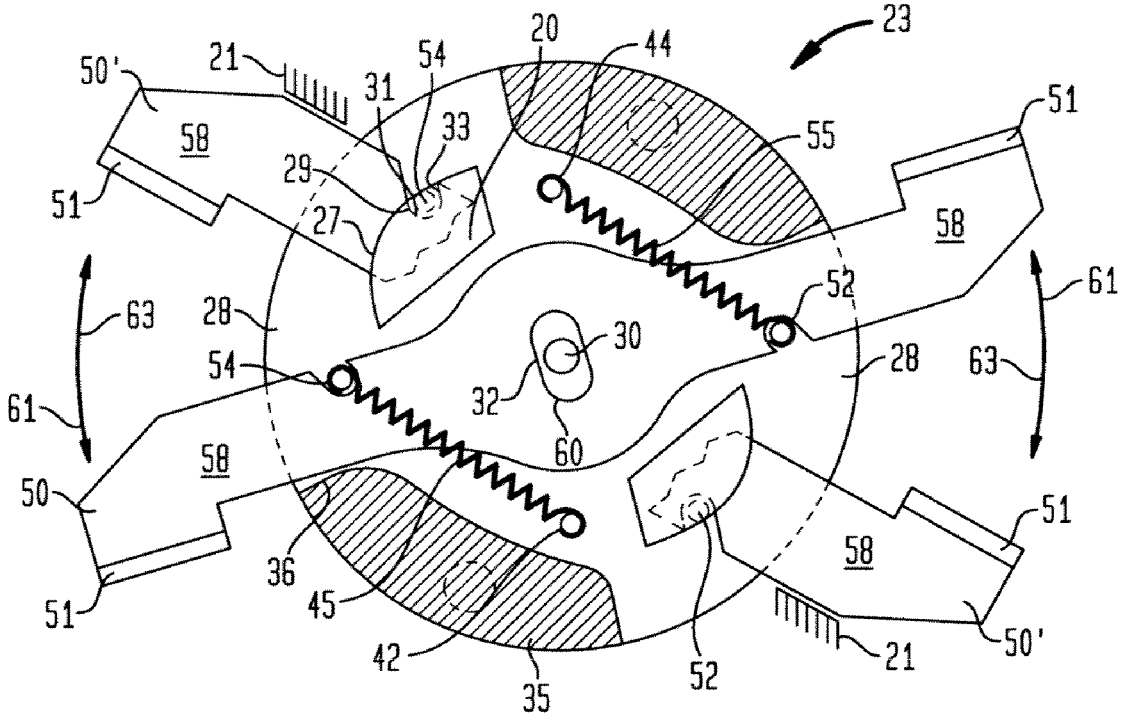
FIG. 4A is a simplified side view sketch of the inventive contact mechanism assembly for a circuit breaker illustrated in FIG. 1, showing the contact arm in an ON-position and then in a blow-off position along with simplified schematically shown one or more structural stop.

FIG. 4A is a simplified side view sketch of the inventive contact mechanism assembly for a circuit breaker 23, illustrated in FIG. 1, showing the contact arm 50, in an ON-position 50, and then in a blow-off position 50', along with simplified schematically shown structural one or more stop 21.

Figure 4B:
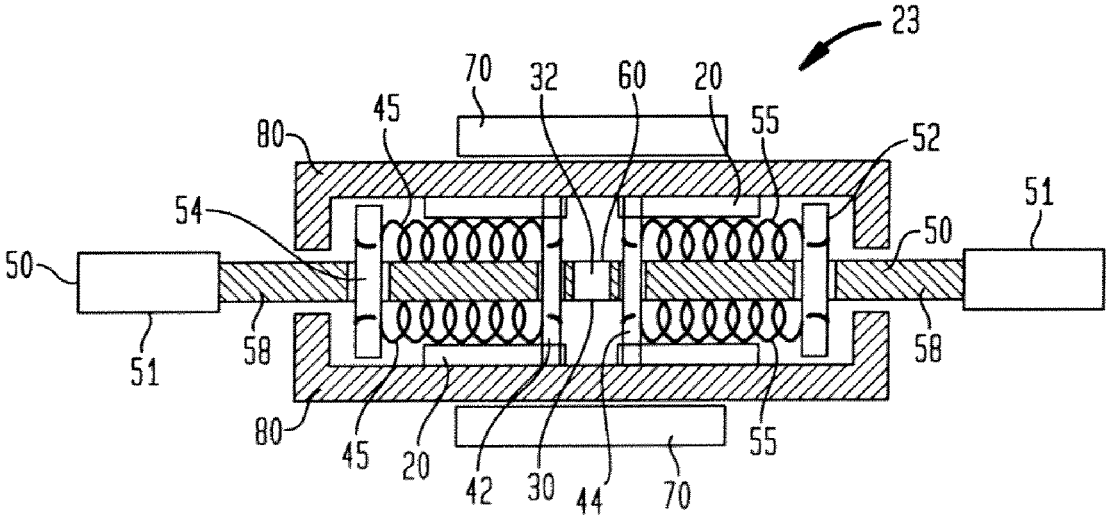
FIG. 4B is a top view of the inventive contact mechanism assembly for a circuit breaker illustrated in FIG. 1.

FIG. 4B is a top view of the inventive contact mechanism assembly for a circuit breaker 23, illustrated in FIG. 1.

Figure 5A:
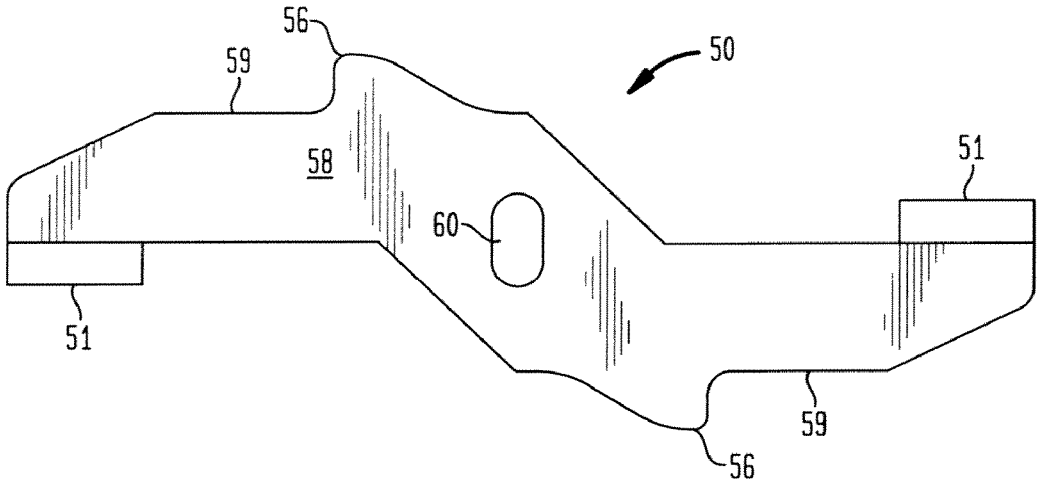
FIG. 5A is an enlarged detailed view showing a first embodiment of a contact arm that can be used with this invention.

FIG. 5A is an enlarged detailed view showing a first embodiment of a contact arm 50, that can be used with this invention.

Figure 5B:
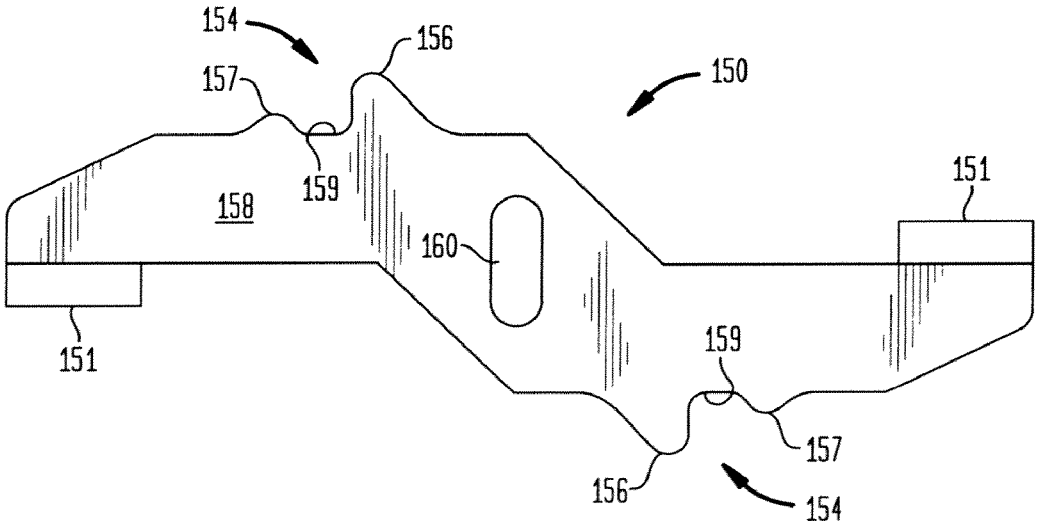
FIG. 5B is an enlarged detailed view showing a second embodiment of a contact arm that can be used with this invention.

FIG. 5B is an enlarged detailed view showing a second embodiment of a contact arm 150, that can be used with this invention.

Now referring to FIGS. 1A through 5B, the inventive contact mechanism assembly for a circuit breaker 23, comprises an arc extinguishing mechanism 10, a pair of fixed contact assemblies 12, each having a fixed contact pad 14. A contact arm assembly 50, having a movable contact 51, a contact arm body 58, contact arm edge-surfaces 59, a bump or notch or hook or structural stop 56, and a slotted hole or opening 60, which encompasses a central pivot axle 32, which is fixed/secured to the crossbar module 80. The contact arm assembly 50 is flexibly connected to the crossbar module 80 using either one or two pairs of springs, namely, a first spring 45, and a second spring 55, such that one end of the first spring 45, is secured to a fixed pin or anchor 42, which is secured to the crossbar module 80, and the other end of the first spring 45, is secured to a sliding pin 54, which is securely held in place by the bump or notch or structural stop 56, in the contact arm 50. Similarly, one end of the second spring 55, is secured to a fixed pin or anchor 44, that is secured to the crossbar module 80, and the other end of the second spring 55, is secured to a sliding pin 52, which is securely held in place by the bump or notch or structural stop 56, in the contact arm 50. The contact arm 50, pivots about a shaft 32, wherein the axle 32, passes through opening 60, and wherein the axle 32, is securely held in place by the crossbar module 80. Preferably, the crossbar module 80, has a round peripheral edge or surface 22.

The crossbar module 80, or the rotation shaft module 80, is fabricated either as one piece or made as a two-half assembly out of a non-electrically conductive material, preferably having an opening or hole 37, for fixing/securing a central pivot axle 32 for independent floating and rotation of the contact arm 50. The crossbar module 80, also comprises two symmetrically oriented locking blocks/protrusions 20, that are arranged integrally either on the inner sides or on the outer circumference surfaces of the crossbar module 80.

In certain cases, assuming a sufficient space within the dimensional 'envelope', the crossbar module 80, configuration can also include a circumferential web 34 protruding out of the inner sides of the crossbar module 80 as clearly shown in the FIG. 2C, so as to provide a physical protection to the contact mechanism components against contamination, such as, by the flying particles, which result from short circuit condition.

It should be appreciated that the central pivot axle 32, is preferably positioned in the geometrical center or pivot point 30, of the crossbar module 80, and is oriented perpendicular to its sides. The central pivot axle 32, can be either integral with or fixed-mounted to the crossbar module 80, or just go through it.

Side walls of the crossbar module 80, have a varying thickness. The locking block/protrusion 20 of the crossbar module 80, preferably has an upper anchor area or surface 24, and a similar lower anchor area or surface 24. On the upper anchor area or surface 24, the fixed pin or anchor 44, having the one end of the spring 55, is secured. On the lower anchor area or surface 24, the fixed pin or anchor 42, having the one end of the spring 45, is secured. The locking/block surface 20, also has an upper pin stop area or locking surface 26, and a similar lower pin stop area or locking surface 26. The locking block/protrusion 20 is integral with side surface 28 of the crossbar module 80. The locking block/protrusion 20 is terminated by a surface 38, by a sequence of locking surfaces 26, limiting surfaces 33, and by connecting protrusions 35. The sequence of locking surfaces 26 comprises surfaces 27, 29 and 31 that are arranged on the locking block/protrusion 20 of the crossbar module 80. Basically, the sequence of the locking surface 26, comprises a first surface 27, a second surface 29, and a locking surface 31. The connecting protrusions 35, of the crossbar module 80, have structural surfaces 36.

As shown in the FIGS. 1A and 1B, the sliding pins 52 and 54, are resting on the outer edges 59 of the contact arm body 58, and are being supported by standouts 56 or by bumps 56 or by cavities/slots 56 or structural stops 56. During blow-off, the sliding pins/rollers 52 and 54, move together with the contact arm 50 toward the sequence of the locking surfaces 26 while not engaging the surfaces 38 of the locking block/protrusion 20. At the very end of their respective trajectories, the sliding pins/rollers 52 and 54 engage the first surface 27 and then the second surface 29 of the sequence of the locking surfaces 26 of the locking blocks/protrusions 20 of the crossbar module 80. The sliding pins/rollers get locked upon reaching locking surfaces 31 of the sequence of the locking surfaces 26 of the locking blocks/protrusions 20 of the crossbar module 80 as clearly shown in the FIGS. 3A and 3B.

The contact arm 50, or contact bridge 50, floats inside the crossbar module 80, and is biased by the two pairs of the contact tension springs, namely springs 45 and 55, that are located inside the crossbar module 80, and are on both sides of the contact arm 50, as shown in FIG. 4B. The contact arm 50, has a central slotted opening or hole 60, which is oriented preferably perpendicularly to the longitudinal plane of the contact arm 50, but, which can also be oriented at a different angle, and surrounds the central pivot axle 32 thus allowing translational motion of the contact arm 50, in the direction of longitudinal axis of the slotted opening 60, but within limits defined by the slot geometry and size. The contact arm 50, also has two or more pin-retaining features 56, such as hooks 56, standouts 56, bumps 56, slots 56, to name a few, that are arranged integrally on the opposite edges of the contact arm 50. Current paths 70 are integral with fixed contact assemblies 12.

The two contact pads 51, also called the moveable contacts 51, are attached symmetrically to the opposite ends of the contact arm 50. In the ON position, the moveable contacts 51, are intended to be pressed against the fixed contact pads 14 that are attached to the fixed contact assembly 12 and that are symmetrical with respect to the geometrical center or pivot point 30 of the crossbar module 80.

As stated earlier that the two sliding pins or rollers 52, 54, are pressed against the anchor-shapes pin-retaining features 56 or 156, but on the opposite edge surfaces 59 or 159 of the contact arm 50 or 150, and serve as moveable supports for the tension springs 45, 55. It is important to point out that in case of the contact arm configuration, which is shown in the FIG. 5B, the sliding pins or rollers 52, 54 are placed in the spaces 154 between the standouts or bumps 156, and the standout or bumps 157. The two anchor pins 42, 44, are mounted symmetrically to the crossbar module 80, but perpendicular to its side surfaces 28, and these anchor pins serve as fixed supports for the tension springs 45, 55.

The two structural stops 21, that are reinforced structural components of the circuit breaker housing or of the circuit breaker contact system housing 100. They are positioned symmetrically at the desired opening angle of the contact arm 50.

FIG. 5A is an enlarged detailed view showing a first embodiment of a contact arm 50, that can be used with this invention.

FIG. 5B is an enlarged detailed view showing a second embodiment of a contact arm 150, that can be used with this invention. It is important to point out that in case of this contact arm configuration, the sliding pins or rollers 52, 54 are placed into the spaces 154 between the standouts or bumps 156 and 157. One purpose of the small bumps 157, is to limit, if needed, inertia-driven linear motion of the sliding pins 52, 54 during the initial moments of the rotation of the contact arm 50, caused by the blow-off forces. It should be appreciated that the sliding pins or rollers 52, 54, are contained between the standouts 156 and 157, and rotate or slide along the edge 159, at spaces 154.

Figure 6:
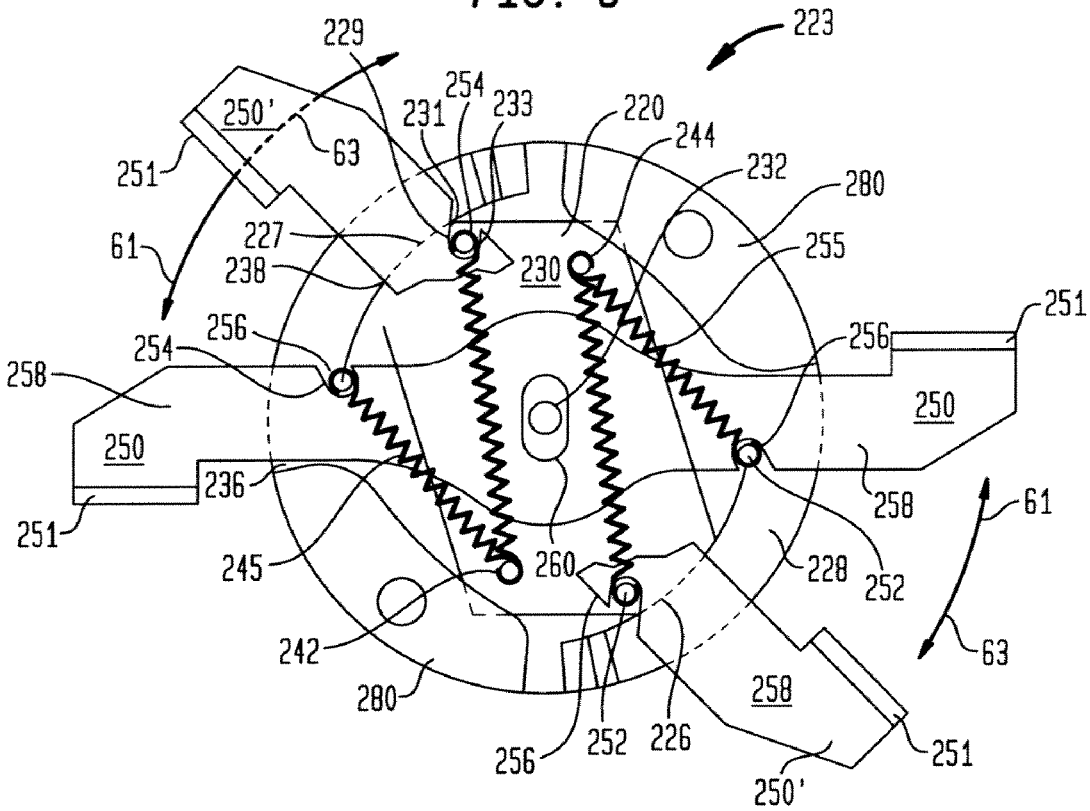
FIG. 6 is a side view of the inventive contact mechanism assembly for a circuit breaker illustrating a second embodiment of the present invention showing the contact arm in an ON-position and then in a blow-off position.

FIG. 6 is a side view of the inventive contact mechanism assembly for a circuit breaker 223, illustrating a second embodiment of the present invention showing the contact arm 250, in an ON-position and then in a blow-off position.

Figure 7:
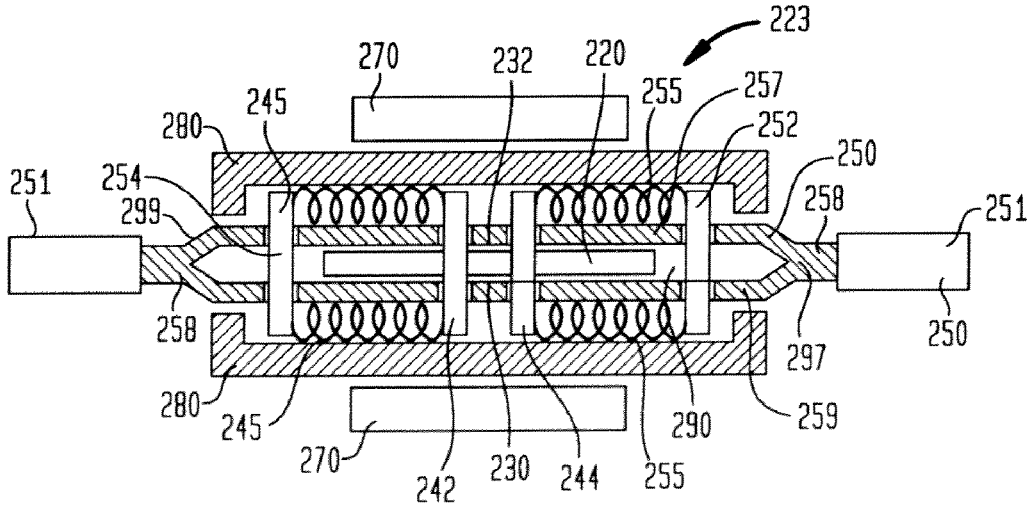
FIG. 7 is a top view of the inventive contact mechanism assembly for a circuit breaker illustrated in FIG. 6.

FIG. 7 is a top view of the inventive contact mechanism assembly for a circuit breaker 223, illustrated in FIG. 6.

Now referring to FIG. 6 and FIG. 7, the crossbar module 280, or the rotation shaft 280, is basically similar to the crossbar module 80, but only without the two symmetrically oriented locking blocks/protrusions 20, on the inner sides of the crossbar module 80.

The split version of the contact arm 250, which consists of two symmetrical formed halves, that are secured together, such as, by brazing or welding or by other methods, to form a contact arm assembly 250, with a space 290, in the middle. The contact arm 250, comprises a first arm 257, and a second arm 259, that are joined together at locations 297, and 299, and then extend as a single unit or extension 258, as clearly seen in FIG. 7. Current paths 270 are integral with the fixed contact assemblies 12.

This contact arm 250, has two sets of pin-retaining shapes 256, hooks 256, standouts 256, bumps 256, that are arranged integrally on the opposite edges of the contact arm halves.

Each half of the contact arm assembly 250, has a central slotted opening or hole 260, which is oriented preferably perpendicularly to the longitudinal plane of the contact arm 250, but, which can also be oriented at a different angle, and surrounds a central pivot axle 232, thus allowing translational motion of the contact arm 250, in the direction of longitudinal axis of the slotted opening 260, within limits defined by the slot geometry and size.

In this case the two symmetrically oriented sequences of locking surfaces 226, comprise a first surface 227, a second surface 229, and a locking surface 231, instead of being integral with sides of the crossbar module 280, are arranged on the outer edges of a separate locking plate 220, fabricated out of a, preferably, an electrically non-conductive or a low-conductive material. This locking plate 220, is located inside the space 290, in the middle of the contact arm 250. The locking plate 220, will be fixed to the crossbar module 280, by mechanical fastening means.

The central pivot axle 232, which is fixed or secured to the crossbar module 280 or to the locking plate 220 or to the both, moveable contacts 251, and fixed contact pads 14, that are attached to the fixed contact assembly 12, two pairs of contact tensions springs, namely, a first spring 245, and a second spring 255, two sliding pins or roller 252, 254, two anchor pins 242, 244, and two structural stops 256, are correspondingly identical to those described for the embodiment illustrated with reference to FIGS. 1A through 5B.

The contact arm 250, pivots about a central pivot axle 232, wherein the axle 232, passes through opening 260, and wherein the axle 232, is securely held in place by the crossbar module 280 or by the locking plate 220 or by the both. The crossbar module 280, has a structural surface 236, which is similar to the structural surface 36, a limiting surface 233, which is similar to the limiting surface 33, a surface 238, which is similar to the surface 38.

Figure 8:
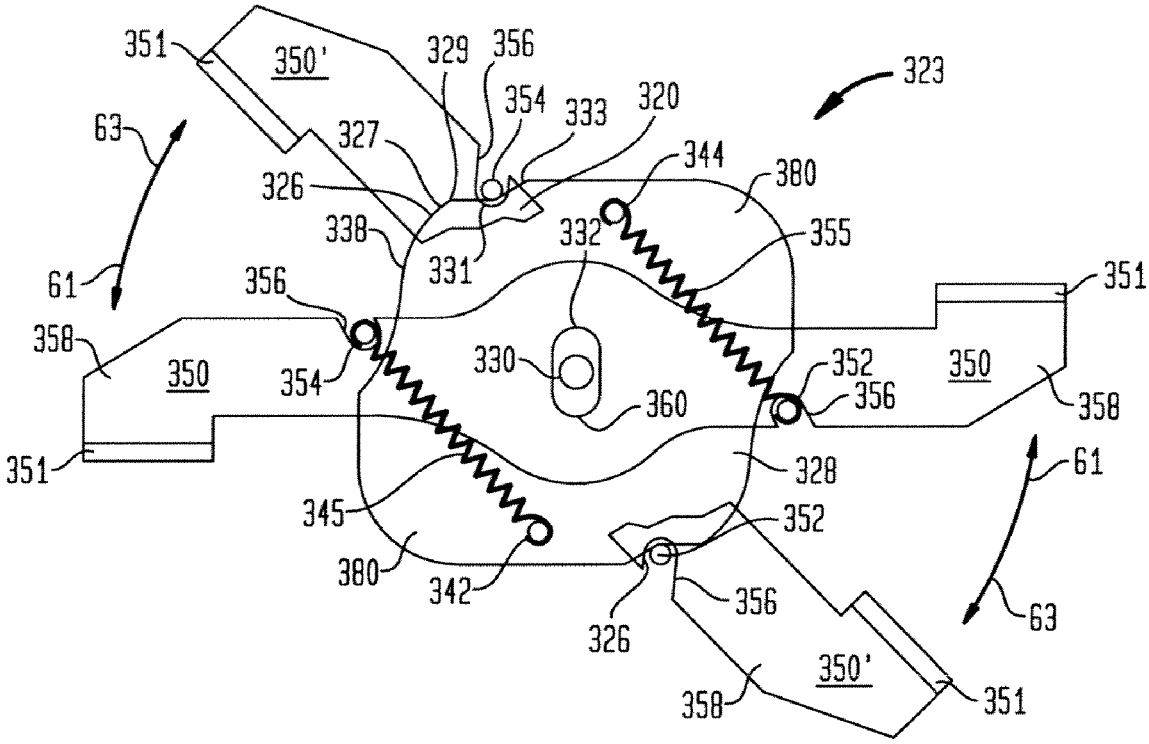
FIG. 8 is a side view of the inventive contact mechanism assembly for a circuit breaker illustrating a third embodiment of the present invention showing the contact arm in an ON-position and then in a blow-off position.

FIG. 8 is a side view of the inventive contact mechanism assembly for a circuit breaker 323, illustrating a third embodiment of the present invention showing the contact arm 350, in an ON-position 350, and then in a blow-off position 350'.

Figure 9:
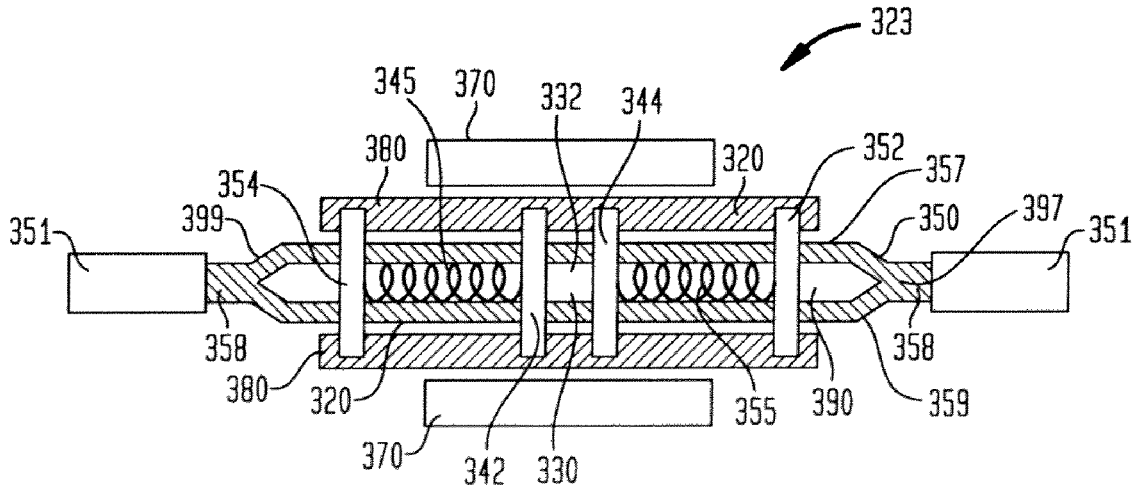
FIG. 9 is a top view of the inventive contact mechanism assembly for a circuit breaker illustrated in FIG. 8.

FIG. 9 is a top view of the inventive contact mechanism assembly for a circuit breaker 323, illustrated in FIG. 8.

Now referring to FIG. 8, and FIG. 9, the crossbar module 380, central pivot axle 332, moveable contacts 351, and fixed contact assemblies 12, two sliding pins or rollers 352, 354, and two anchor pins 342, 344, are correspondingly identical to those described for the preferred embodiment of FIGS. 1A through 5B.

A split contact arm assembly 350, identical to the one described for the second embodiment described in FIGS. 6 and 7.

The split version of the contact arm 350, which consists of two symmetrical formed halves, that are secured together, such as, by brazing or welding or by other methods, to form a contact arm assembly 350, with a space 390, in the middle. The contact arm 350, comprises of a first arm 357, and a second arm 359, that are joined together at locations 397, and 399, and then extend as a single unit or extension 358, as clearly seen in FIG. 9. Current paths 370 are integral with the fixed contact assemblies 12.

One pair of larger contact springs, namely, a first contact spring 345, and a second contact spring 355, in comparison to those described for the preferred embodiment. This one pair of larger contact springs 345, 355, is located inside the space 390, between the halves of the contact arm assembly 350.

Each half of the contact arm assembly 350, has a central slotted opening or hole 360, which is oriented preferably perpendicularly to the longitudinal plane of the contact arm 350, but, which can also be oriented at a different angle, and surrounds a central pivot axle 332, which is fixed or secured to the crossbar module 380, thus allowing translational motion of the contact arm 350, in the direction of longitudinal axis of the slotted opening 360, within limits defined by the slot geometry and size.

In this case the two symmetrically oriented locking surfaces 326, comprise a first surface 327, a second surface 329, and a locking surface 331, instead of being integral with sides of the crossbar module 380, are arranged on the outer edge surfaces of crossbar module 380.

The central pivot axle 332, moveable contacts 351, and fixed contact pads 14, that are attached to the fixed contact assembly 12, two pairs of contact tensions springs, namely, a first spring 345, and a second spring 355, two sliding pins or roller 352, 354, two anchor pins 342, 344, and two standouts or bumps or structural stops 356, are correspondingly identical to those described for the embodiment illustrated with reference to FIGS. 1A through 5B.

The contact arm 350, pivots or floats about a central axle 332, wherein the axle 332, passes through opening 360, and wherein the axle 332, is securely held in place by the crossbar module 380. The crossbar module 380, has a structural surface 336, which is similar to the structural surface 36, a limiting surface 333, which is similar to the limiting surface 33, a surface 338, which is similar to the surface 38, and a side surface 328, which is similar to the side surface 28.

In order to further illustrate the operations of this invention we use FIG. 1A through FIG. 5B as an example, however, the operation mechanism would be the same for the other embodiments. In the ON position 50, the contact springs 45, 55, supported by the sliding pins 52, 54, are pressed against the anchor-shapes pin-retaining features 56, of the contact arm 50, and by the anchor pins 42, 44, that are fixed to the crossbar module 80, to create a force-couple, which generates a required contact torque at the contact arm 50, with respect to the central pivot 32, 60. This contact torque in turn creates a pair of equally balanced pressing forces between the moveable contacts 51, and the fixed contacts 14 that are attached to the fixed contact assembly 12. It is important to point out that the sliding pins or rollers 52, 54, do not engage the aforesaid surfaces of the locking blocks/protrusions 20, in the ON position.

During blow-off, the electro-magnetic repulsion forces cause a highly accelerated disengagement of the moveable contacts 51, from the fixed contact pads 14 of the fixed contact assemblies 12, thus causing the contact arm 50, along with the sliding pins or rollers 52, 54, to rotate in a clockwise direction towards the full-open position, as indicated by arrow 63. This motion of the contact arm 50, stretches the contact springs 45, 55, thus increasing the spring force applied to the contact arm 50. However, at the same time with rotation of the contact arm 50, the springs 45, 55, within each pair move closer to each other and closer to the central pivot axle 32, thus reducing the moment arm with respect to the center of rotation or pivot point 30, 230, 330. This ensures relatively equalized torque at the contact arm 50, which resists the rotational opening motion of the contact arm 50. At the end of the trajectory of the contact arm 50, the sliding pins or rollers 52, 54, engage the sequence of the locking surfaces 26 that comprises locking surfaces 27, 29 and 31, of the locking blocks/protrusions 20, of the crossbar module 80. The torque at the contact arm 50, created by the resultant forces, will decrease while the sliding pins or rollers 52, 54, engage the locking surfaces 27, and then 29, until it becomes negative when the sliding pins or rollers 52, 54, reach the locking surfaces 31, of the locking blocks/protrusions 20, thus resisting the reverse rotation of the contact arm back to the closed contacts position and effectively locking the contact arm 50, in the blow-off position.

The contact arm 50, will be in the reverse rotation and movable contacts 51, will re-close automatically with the fixed contact pads 14 of the fixed contact assembly 12, if the blow-off force disappears before the sliding pins or rollers 52, 54 reach the locking surface 31 of the sequence of locking surfaces 26 of the locking blocks/protrusions 20, as illustrated by arrows 61. Otherwise, the contact arm 50, will be locked in the blow-open position at the required angle at the locking surface 31 of the sequence 26.

The tripping motion of the crossbar module 80, takes place after the repulsion opening of the movable contacts 51, from the fixed contacts 12, and the blow-off rotation of the contact arm 50 in the direction 63. The breaker operating mechanism, which is not described in this invention, rotates the crossbar module 80, in a clockwise direction 63, to catch up with the contact arm 50, and to indicate the breaker 'Trip' state. In the beginning of this clockwise rotation 63, of the crossbar module 80, the sliding pins/rollers 52, 54 are pressed against the locking surface 31 of the sequence of the locking surfaces 26 of the locking blocks/protrusions 20 of the crossbar module 80 and against the structural stops 56 or against edge surfaces 59 of the contact arm 50. As the crossbar module 80 keeps rotating in the direction 63, the sliding pins/rollers 52, 54 remaining pressed against the structural stops 56 or against edges 59 of the contact arm 50 but they disengage from the locking surface 31 and engage the locking surface 29, then disengage it as well and engage the locking surface 27 of the sequence of the locking surfaces 26 of the locking block/protrusion 20. Immediately after that the sliding pins/rollers 52, 54 completely disengage from the locking block/protrusion 20 or from the locking plate 220 in case of the second embodiment.

As the disengagement happens, the contact arm 50, rotates in a counter-clockwise direction 61, biased by the contact springs 45, 55, toward the ON position, but then, at a certain pre-determined angle it engages structural surfaces 36, of the crossbar module 80, which is being rotated in the clockwise direction 63 by the operating mechanism of the circuit breaker 23. The contact arm 50 then rotates together with the crossbar module 80 (clockwise) in the direction 63 back to the blow-off position, which indicates a 'Trip' state of the breaker.

During normal opening operation of the circuit breaker 23, operating mechanism rotates the crossbar module 80, in a clockwise direction 63, from the ON position toward the OPEN or a TRIP positions. The structural surfaces 36 of the crossbar module 80, engage the contact arm 50, and force it to separate the moveable contacts 51, from the fixed contact pads 14 of the fixed contact assembly 12, and to rotate in a clockwise direction 63, together with the crossbar module 80, toward the OPEN or a TRIP positions.

For closing the contacts of the circuit breaker 23, operating mechanism rotates the crossbar module 80, in a counter-clockwise direction 61, from the OPEN or TRIP position towards the ON position. This rotation of the crossbar module 80, removes the force applied by the crossbar's structural surface 36, as an active body, towards the contact arm 50. This removal of the active force allows the contact arm 50, which is biased by the contact springs 45, 55, to rotate in a counter-clockwise direction 61, towards the ON position thus closing the moveable contacts 51, and the fixed contact pads 14 of the fixed contact assembly 12. When the crossbar module 80, along with the anchor pins 42, 44, approaches its ON position, the contact springs 45, 55, are being oriented and stretched to the length required to produce sufficient force-couple, which results in the required torque level at the contact arm 50, which in turn creates a specified pressure forces between the moveable contacts 51, and the contact pads 14 of the fixed contact assembly 12.

With this invention a loss of the contact force/torque due to the over-travel of the contact arm 50 pass its initial ON position is substantially reduced in comparison to the conventional art systems that use intermediate cam surface for generating contact pressure. Over-travel condition, which can happen in a number of ways as a result of reduced thickness of either fixed contact pads 14 of the fixed contact assembly 12, or the moveable contact pads 51, or both because of loss of the contact pad material due to erosion, causes the contact arm 50 to rotate past its initial ON position. This reduces the stretching of the contact springs 45, 55, thus resulting in decrease of the spring forces applied to the contact arm 50. At the same time, however, with rotation of the contact arm 50, past the initial ON position the springs 45, 55, within each pair move away from each other and also farther away from the central pivot point or axle 32, thus increasing the moment arm with respect to the center of rotation or pivot point 30, 230, 330. Once again, this ensures relatively equalized torque at the contact arm 50, when the moveable contact 51, and the fixed contact pads 14 of the fixed contact assembly 12, are closed or made to contact each other in an over-travel ON position.

In case of unequal line and load side contact erosion, the slotted profile of the central opening 60, in the contact arm 50, enables shifting of the true center of rotation along the longitudinal axis of the slotted opening 60. In this case, difference between the moment arm lengths will balance a difference between spring forces on a line and load sides, thus, once again, relatively equalizing torque at the contact arm 50, and uniformly distributing contact pressure forces when the moveable contacts 51, and the fixed contact pads 14 of the fixed contact assembly 12, are closed or made to contact each other in an over-travel ON position.

As stated earlier that this invention allows the direct transfer of the torque from stored energy components, such as the springs 45, 55, to the contact arm 50, in the ON position (contacts closed) without using any intermediate cam surface.

With this invention one also gets the reliable locking of the contact arm 50, in the blow-off position using stationary means that are integral with or fastened to the crossbar module, such as the locking blocks/protrusions 20, that are made either integral with the crossbar module, as in the preferred embodiment 23, and in the third embodiment 323, or such as locking plate 220, which is mechanically fastened to the crossbar module 280, as in the second embodiment 223.

The locking blocks/protrusions 20, of the crossbar module 80, in the preferred embodiment 23, and in the third embodiment 323, or of the locking plate 220, in the second embodiment 223 comprise a sequence of pin-engaging or locking surfaces 26, which consists of three major consecutive surfaces, namely, first surface 27 and second surface 29, and locking surface 31.

The first surface 27 and the second surface 29 are located, oriented and sized in a pre-determined manner, either as option A or option B or option C.

In option A, the first surface 27 can have its center of curvature located outside the material block, and the second surface 29, can have its center of curvature located inside the material block. This kind of surface transition, being properly designed, sized and oriented, will allow for a smooth engagement between the sliding pins or rollers 52, 54, and the locking block/protrusion 20 of crossbar module 80 for the preferred embodiment 23, or locking plate 220 for the second embodiment 223, thus reducing an impact force on the crossbar module 80, during the blow-off rotational motion of the contact arm 50.

In option B, the first surface 27, can be a straight surface and the second surface 29, can have its center of curvature located inside the material block. This kind of surface transition, being properly designed, sized and oriented, will allow for a smooth engagement between the sliding pin or roller 52, 54, and the locking block/protrusion 20 of crossbar module 80, or locking plate 220 for the second embodiment 223, thus reducing an impact force on the crossbar module 80, during the blow-off rotational motion of the contact arm 50.

In option C, the first surface 27, can have its center of curvature located inside the material block, and the second surface 29, can have its center of curvature located also inside the material block. This kind of surface transition being properly designed, sized and oriented will allow for a smooth engagement between the sliding pins or rollers 52, 54, and the locking block/protrusion 20 of crossbar module 80 for the preferred embodiment 23, or locking plate 220 for the second embodiment 223, thus reducing an impact force on the crossbar module 80, during the blow-off rotational motion of the contact arm 50.

The locking surface 31, preferably, is a straight surface, which is located and oriented in a pre-determined manner at a certain pre-determined angle to ensure retaining the sliding pin or roller 52, 54, at the end of the blow-off trajectory thus locking the contact arm 50, in the blow-off position and preventing it from a nuisance rotation toward the ON position.

As shown in FIGS. 5A and 5B, the contact arm 50, 150, features two or more pin-retaining shapes or structural stops 56, such as, hooks 56, standouts 56, bumps 56, cavities/slots 56, to name a few, that are arranged integrally on the opposite outer edges of the contact arm 50, and that serve as means to limit motion of the sliding pins or rollers 52, 54, with respect to the contact arm 50, thus still allowing the sliding pins or rollers 52, 54, to slightly move along the edges 49 of the contact arm 50, while enabling a direct transfer of torque from the springs 45, 55, to the contact arm 50.

Both the second embodiment 223, and the third embodiment 323, feature a 'split' version of the contact arm 250, 350, which consists of two symmetrical formed halves, that are brazed or welded together to form a contact arm 250, 350, assembly with a space 290, 390, respectively, in the middle.

For the second embodiment 223, the available space 290, in the middle between the symmetrical halves 257, 259, of the contact arm 250, enables placing a single locking plate 220, right in the center of the mechanism. At the same time, the sliding pin or roller 252, 254, are supported by and can slide along the two edges of the symmetrical halves 257, 259, of the contact arm 250. These both features are beneficial from the standpoint of stability and equilibrium of the motion when the contact arm 250, is in rotation and when it gets locked. Furthermore, from the stand point of structural rigidity, if the locking plate 220, is made out of a preferably low electrically conductive metal it enables a rigid metal-on-metal contact between the sliding pins or rollers 252, 254, and the locking plate 220.

For the third embodiment 323, the available space 390, in the middle between the symmetrical halves 357, 359, of the contact arm 350, enables placing a single pair of contact springs 345, 355, right in the center of the mechanism. At the same time, the sliding pins or rollers 352, 354, are supported by and can slide along the two edges of the symmetrical halves 357, 359, of the contact arm 350. These both features are beneficial from the standpoint of stability and equilibrium of the motion during the rotation and locking of the contact arm 350. Furthermore, it enables reducing quantity of the contact springs 345, 355, from four to two that is one pair instead of two pairs.

A crossbar module 80, configuration described in this invention, may also feature, assuming sufficient space within a dimensional 'envelope', an integral circumferential web 34 protruding out of the inner sides of the crossbar module 80 as shown in the FIG. 2C, to provide a physical protection to the contact mechanism components against contamination by flying particles resulting from short circuit condition.

As one can appreciate that with this invention the contact torque or force in the ON position and during much of the contact arm's trajectory is generated through direct transfer of spring force from the contact springs to the contact arm without using the cam surface. This invention also provides a reliable locking of the contact arm at the end of its trajectory during short circuit when it is acted upon by the sufficient electro-magnetic repulsion forces. It is worth of pointing out a resulting characteristics of this invention, which is minimization of the reduction of the contact torque or force that occurs during over-travel due to contact erosion. This invention has also minimized or eliminated effect of friction on the mechanism performance, such that the hysteresis are either very small or non-existent. Additionally, the inventive crossbar provides enclosure and physical protection to the contact mechanism.

The contact arm 50, 250, 350, is preferably made of a metallic material, wherein the metallic material is selected from a group comprising, aluminum, steel, copper, composite material, and combination thereof, to name a few.

The cross-bar module 80, 280, 380, is preferably made of a plastic material, and preferably featuring thermal stability capabilities.

The locking block/protrusions 20 and 320, is preferably made of a plastic material, and preferably featuring thermal stability capabilities.

The locking plate 220 is preferably made of a plastic material, and preferably featuring thermal stability capabilities. In certain designs, the locking plate 220 can be made out of a preferably electrically non-conductive or very low electrically conductive metallic material.

The slotted opening 60, is preferably selected from a group comprising, an oval shaped slot, a circular shaped slot, a trapezoidal shaped slot, a square shaped slot, a rectangular shaped slot, an elliptical shaped slot, a triangular shaped slot, and combination thereof, to name a few.

The material for the various components of this invention could be selected from a group comprising, a plastic material, a thermally stable plastic material, an electrically non-conductive material, a very low electrically conductive metallic material, and combination thereof, to name a few.

As stated earlier that adjacent the limiting surface 33, is a pin stop area 26, wherein the pin stop area 26, preferably comprises a first portion 27, a second portion 29, and a third portion 31, wherein during a blow-off of the contact arm, the first portion 27, is an engaging surface 27, for the sliding pin 52, 54, the second portion 29, is a ratchet surface 29, and the third portion 31, is a locking surface 31, for the sliding pin 52, 54.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A mechanism for rotary double-break contact system for a circuit breaker, comprising:

(a) a crossbar module, wherein said crossbar module has a protrusion integral with a side of the crossbar module, the protrusion including a first anchor area and a second anchor area, wherein the protrusion is terminated by a first limiting surface and a second limiting surface, a surface, connecting protrusions and a first sliding pin stop area and a second sliding pin stop area, the crossbar module further has a first sliding pin travel surface and a second sliding pin travel surface, a first contact arm resting surface and a second contact arm resting surface;

(b) a contact arm, wherein said contact arm has a first movable contact and a second movable contact, a first structural stop and a second structural stop, a first outer traveling edge and a second outer traveling edge, and a contact arm slotted opening;

(c) an axel, wherein said axel passes through said contact arm slotted opening and said axel is secured to said crossbar, and said axel allows the pivoting of said contact arm about said axel;

(d) a first spring, wherein one end of said first spring is secured to a first fixed pin and the other end of said first spring is secured to a first sliding pin, and wherein said first pin is secured to said first anchor area on said crossbar module and said first sliding pin is held in place by said first structural stop in said contact arm;

(e) a second spring, wherein one end of said second spring is secured to a second fixed pin and the other end of said second spring is secured to a second sliding pin, and wherein said second phi is secured to said second anchor area on said crossbar module and said second sliding pin is held in place by said second structural stop in said contact arm; and (f) wherein in an ON position said contact arm rests at said first contact arm resting area and said second contact arm resting area, and wherein in a blow-off position said first sliding pin and said second sliding pin engages said first structural stop and said second structural stop of said contact arm and moves said contact arm towards said first limiting surface and said second limiting surface, and thereby forms said mechanism for rotary double-break contact system for a circuit breaker.

2. The mechanism for rotary double-break contact system for a circuit breaker of claim 1, wherein adjacent said first limiting surface is the first sliding pin stop area wherein said first sliding pin stop area comprises a first portion, a second portion and a third portion, and wherein during said blow-off of said contact arm, said first portion is an engaging surface for said first sliding pin, said second portion is a ratchet surface, and said third portion is a locking surface for said first sliding pin.

3. The mechanism for rotary double-break contact system for a circuit breaker of claim 1, wherein adjacent said second limiting surface is the second sliding pin stop area wherein said second sliding pin stop area comprises a first portion, a second portion and a third portion, and wherein during said blow-off of said contact arm, said first portion is an engaging surface for said second sliding pin, said second portion is a ratchet surface, and said third portion is a locking surface for said second sliding pin.

4. The mechanism for rotary double-break contact system for a circuit breaker of claim 1, wherein said movable contact has at least one contact pad.

5. The mechanism for rotary double-break contact system for a circuit breaker of claim 1, wherein in said ON position a first fixed contact assembly engages said first movable contact, and a second fixed contact assembly engages said second movable contact.

6. The mechanism for rotary double-break contact system for a circuit breaker of claim 1, wherein during a blow-off a first arc extinguishing mechanism engages said first movable contact, and a second arc extinguishing mechanism engages said second movable contact.

7. The mechanism for rotary double-break contact system for a circuit breaker of claim 1, wherein said crossbar module has an integral webbing.

8. The mechanism for rotary double-break contact system for a circuit breaker of claim 1, wherein said contact arm is preferably made of a metallic material, wherein said metallic material is selected from a group consisting of aluminum, steel, copper, composite material, and combination thereof.

9. The mechanism for rotary double-break contact system for a circuit breaker of claim 1, wherein said cross-bar module is preferably made of a plastic material, and wherein said plastic material comprises a thermally stable plastic material.

10. The mechanism for rotary double-break contact system for a circuit breaker of claim 1, wherein the protrusion is a locking block protrusion, and wherein said locking block protrusion is preferably made of a plastic material, and wherein said plastic material comprises a thermally stable plastic material.

11. The mechanism for rotary double-break contact system for a circuit breaker of claim 1, wherein material for said crossbar module is selected from a group consisting of a plastic material, a thermally stable plastic material, an electrically non-conductive material, a very low electrically conductive metallic material, and combination thereof.

12. The mechanism for rotary double-break contact system for a circuit breaker of claim 1, wherein said slotted opening in said contact arm is preferably selected from a group consisting of an oval shaped slot, a circular shaped slot, a trapezoidal shaped slot, a square shaped slot, a rectangular shaped slot, an elliptical shaped slot, a triangular shaped slot, and combination thereof.

13. The mechanism for rotary double-break contact system for a circuit breaker of claim 1, wherein said first structural stop in said contact arm comprises a first bump and a second bump, and wherein said first sliding pin is engageably held within said first bump and said second bump.

14. The mechanism for rotary double-break contact system for a circuit breaker of claim 1, wherein said second structural stop in said contact arm comprises a first bump and a second bump, and wherein said second sliding pin is engageably held within said first bump and said second bump.

15. A mechanism for rotary double-break contact system for a circuit breaker, comprising:

(a) a crossbar module;

(b) a locking plate, wherein said locking plate has a first anchor area and a second anchor area, a first limiting surface and a second limiting surface, a first sliding pin travel surface and a second sliding pin travel surface, a first sliding pin stop area and a second sliding pin stop area on an outer edge of the locking plate, a first contact arm resting surface and a second contact arm resting surface;

(c) a contact arm, wherein said contact arm has a first movable contact and a second movable contact, a first structural stop and a second structural stop, a first outer traveling edge and a second outer traveling edge, a contact arm slotted opening, and wherein said contact arm further comprises a first arm and a second arm, and wherein said first arm and said second arm are connected to each other adjacent said first movable contact and said second movable contact and forming an opening, wherein the locking plate is positioned in the opening;

(d) an axel, wherein said axel passes through said contact arm slotted opening and said locking plate and said axel is secured to said crossbar, and said axel allows the pivoting of said contact arm about said axel;

(e) a first spring, wherein one end of said first spring is secured to a first fixed pin and the other end of said first spring is secured to a first sliding pin, and wherein said first pin is secured to said first anchor area on said locking plate and said first sliding pin is held in place by said first structural stop in said contact arm;

(f) a second spring, wherein one end of said second spring is secured to a second fixed pin and the other end of said second spring is secured to a second sliding pin, and wherein said second pin is secured to said second anchor area on said locking plate and said second sliding pin is held in place by said second structural stop in said contact arm; and (g) wherein in an ON position said contact arm rests at said first contact arm resting area and said second contact arm resting area, and wherein in a blow-off position said first sliding pin and said second sliding pin engages said first structural stop and said second structural stop of said contact arm and moves said contact arm towards said first limiting surface and said second limiting surface, and thereby forms said mechanism for rotary double break contact system for a circuit breaker.

16. The mechanism for rotary double-break contact system for a circuit breaker of claim 15, wherein said locking plate is preferably made of a plastic material, and wherein said plastic material comprises a thermally stable plastic material.

17. The mechanism for rotary double-break contact system for a circuit breaker of claim 15, wherein material for said locking plate is selected from a group consisting of a plastic material, a thermally stable plastic material, an electrically non-conductive material, a very low electrically conductive metallic material, and combination thereof.

18. A mechanism for rotary double-break contact system for a circuit breaker, comprising:

(a) a crossbar module;

(b) a locking plate, wherein said locking plate is integrated with crossbar module, and wherein said locking plate has a first anchor area and a second anchor area, a first limiting surface and a second limiting surface, a first sliding pin travel surface and a second sliding pin travel surface, a first sliding pin stop area and a second sliding pin stop area arranged on an outer edge surface of the crossbar module, a first contact arm resting surface and a second contact arm resting surface;

(c) a contact arm, wherein said contact arm has a first movable contact and a second movable contact, a first structural stop and a second structural stop, a first outer traveling edge and a second outer traveling edge, a contact arm slotted opening, and wherein said contact arm further comprises a first arm and a second arm, and wherein said first arm and said second arm are connected to each other adjacent said first movable contact and said second movable contact and forming an opening;

(d) an axel, wherein said axel passes through said contact arm slotted opening and said axel is secured to said crossbar, and said axel allows the pivoting of said contact arm about said axel;

(e) a first spring, wherein said first spring is inside said opening in said contact arm, and wherein one end of said first spring is secured to a first fixed pin and the other end of said first spring is secured to a first sliding pin, and wherein said first pin is secured to said first anchor area on said locking plate and said first sliding pin is held in place by said first structural stop in said contact arm;

(f) a second spring, wherein said second spring is inside said opening in said contact arm, and wherein one end of said second spring is secured to a second fixed pin and the other end of said second spring is secured to a second sliding pin, and wherein said second pin is secured to said second anchor area on said locking plate and said second sliding pin is held in place by said second structural stop in said contact arm; and (g) wherein in an ON position said contact arm rests at said first contact arm resting area and said second contact arm resting area, and wherein in a blow-off position said first sliding pin and said second sliding pin engages said first structural stop and said second structural stop of said contact arm and moves said contact arm towards said first limiting surface and said second limiting surface, and thereby forms said mechanism for rotary double-break contact system for a circuit breaker.

19. The mechanism for rotary double-break contact system for a circuit breaker of claim 18, wherein said locking plate is preferably made of a plastic material, and wherein said plastic material comprises a thermally stable plastic material.

20. The mechanism for rotary double-break contact system for a circuit breaker of claim 18, wherein material for said locking plate is selected from a group consisting of a plastic material, a thermally stable plastic material, an electrically nonconductive material, a very low electrically conductive metallic material, and combination thereof.

21. The mechanism for rotary double-break contact system for a circuit breaker of claim 18, wherein said locking plate and said crossbar module is preferably made of a plastic material, and wherein said plastic material comprises a thermally stable plastic material.

22. The mechanism for rotary double-break contact system for a circuit breaker of claim 18, wherein material for said locking plate and said crossbar module is selected from a group consisting of a plastic material, a thermally stable plastic material, an electrically non-conductive material, a very low electrically conductive metallic material, and combination thereof.

23. A crossbar module for a circuit breaker, comprising, a protrusion integral with a side of the crossbar module, the protrusion including a first anchor area and a second anchor area, wherein the protrusion is terminated b a first limiting surface and a second limiting surface, a surface, connecting protrusions and a first sliding pin stop area and a second sliding pin stop area, the crossbar module further has a first sliding pin travel surface and a second sliding pin travel surface, a first contact arm resting surface and a second contact arm resting surface, and thereby forming said crossbar module for a circuit breaker.

24. The crossbar module of claim 23, wherein adjacent said first limiting surface is a pin stop area wherein said first pin stop area comprises a first portion, a second portion and a third portion, and wherein during a blow-off of a contact arm, said first portion is an engaging surface for a first sliding pin, said second portion is a ratchet surface, and said third portion is a locking surface for said first sliding pin.

25. The crossbar module of claim 23, wherein adjacent said second limiting surface is a second pin stop area wherein said second pin stop area comprises a first portion, a second portion and a third portion, and wherein during a blow-off of a contact arm, said first portion is an engaging surface for a second sliding pin, said second portion is a ratchet surface, and said third portion is a locking surface for said second sliding pin.

* * * * *